United States Patent [19]

Beebe

[11] 4,166,091

[45] Aug. 28, 1979

[54] PRODUCTION OF PLEXIFILAMENT STRANDS

[75] Inventor: Edwin V. Beebe, Waynesboro, Va.

[73] Assignee: E. I. Du Pont de Nemours and Company, Wilmington, Del.

[21] Appl. No.: 351,819

[22] Filed: Apr. 17, 1973

[51] Int. Cl.[2] ..... D01F 6/00

[52] U.S. Cl. ..... 264/205; 260/29.6 AN; 260/29.6 AB; 264/206; 264/211

[58] Field of Search ..... 260/29.6 AN, 29.6 AQ, 260/29.6 AB, 78 S, 41; 161/178; 264/206, 184, 211, 5, 176 F, 205; 162/157 R

[56] References Cited

U.S. PATENT DOCUMENTS

| | | | |
|---|---|---|---|
| 2,585,444 | 2/1952 | Coxe | 264/182 |
| 2,585,499 | 2/1952 | Rothrock | 264/182 |
| 2,684,348 | 7/1954 | Dietrich et al. | 264/206 |
| 2,764,468 | 9/1956 | Hare | 264/177 F |
| 2,865,880 | 12/1958 | Caldwell | 264/206 |
| 3,377,323 | 4/1968 | Ioka et al. | 260/75 T |
| 3,432,483 | 3/1969 | Peoples et al. | 260/78 S |
| 3,472,801 | 10/1969 | Lerman et al. | 264/5 |
| 3,542,715 | 11/1970 | White | 161/178 |
| 3,627,733 | 12/1971 | Ioka et al. | 260/78 S |
| 3,634,575 | 1/1972 | Serad | 264/206 |
| 3,655,857 | 4/1972 | Bohrer et al. | 264/182 |
| 3,669,919 | 6/1972 | Champ | 260/29.6 AQ |
| 3,770,663 | 11/1973 | Ueki et al. | 260/37 N |
| 3,770,856 | 11/1973 | Ueki et al. | 264/13 |
| 3,774,387 | 11/1973 | Woodell | 161/172 |

*Primary Examiner*—Jay H. Woo

[57] ABSTRACT

A process is disclosed for producing plexifilament strands from an organic, synthetic substantially water-insoluble polymer having a selected melting point, by flash-extruding a dispersion of the polymer in water under specified conditions. The plexifilament strands produced are useful in preparing fabrics.

14 Claims, No Drawings

PRODUCTION OF PLEXIFILAMENT STRANDS

FIELD OF THE INVENTION

This invention relates to compositions and processes for preparing plexifilamentary shaped structures of synthetic, organic fiber-forming polymers. More particularly the invention is directed to the preparation of such plexifilament strands by flash-extrusion of a dispersion of the polymer in water.

BACKGROUND

It is known to produce plexifilamentary products by various methods. For example, they can be produced by mechanically working or "fibrillating" highly oriented sheets, bands, films, foils, ribbons or filaments of synthetic polymers. Another method involves shaping filaments or sheets comprising two or more mutually incompatible polymers, orientating the shaped structure and then mechanically working it to cause fibrillation; alternatively, one of the two incompatible polymers may be dissolved away to leave a fibrillated product.

Plexifilamentary strands can also be produced by flash-extruding a solution of a synthetic organic polymer in an activating organic liquid (comprising a solvent) under superatmospheric pressure and at a temperature in excess of the boiling point of the solvent into a region of lower pressure. The flash extrusion procedure requires the use of organic materials which must be separated and recovered. In addition, such materials create fire and toxicity hazards, and also require the use of costly recovery systems.

The process of this invention avoids the use of organic solvents by employing water in their place, and permits the extremely rapid spinning of plexifilamentary yarn strands from a single-orifice extruder.

SUMMARY OF THE INVENTION

The process of this invention is a process for producing plexifilament strands which comprises in sequence:

(1) mixing water and an organic, synthetic substantially water-insoluble fiber-forming polymer which either of itself or its water association complex has a melting point about 100° C. and below 300° C. to obtain a substantially uniform dispersion thereof, the concentration of the polymer being between about 25% and 45% by weight based on the total weight of the dispersion, (2) heating the dispersion to a temperature between about 200° C. and about 300° C. but above the melting point of the polymer or the complex formed by the polymer and water, if any, under at least autogenous pressure, while maintaining the uniformity of dispersion, said heating occurring at a rate to minimize degradation of the polymer, and (3) promptly extruding the dispersion abruptly into a region of substantially lower temperature and pressure.

The composition of this invention is the dispersion to be extruded just prior to step (3). In other words, the dispersion contains substantially molten polymer or its complex with water as one phase and water as the other under at least autogenous pressure at a temperature above the melting point of the polymer or its water-association complex.

In a highly preferred embodiment the dispersion to be extruded will contain between about 1% and 25%, preferably 3–25%, by weight based on the weight of the organic polymer of a water-insoluble nucleating agent stabilizer comprising water-insoluble inorganic oxides, their hydrates or salts thereof, e.g., alumina, silica, titania and inorganic silicates.

DESCRIPTION OF THE INVENTION

This invention describes the flash extrusion of a variety of organic, water-insoluble polymers in a dispersion with water to obtain plexifilament strands. The water flashes off rapidly at the extrusion temperatures and pressures employed when the dispersion is exposed to regions of lower temperature and pressure, such as the atmospheric conditions. Plexifilamentary strands are produced under the conditions described hereinbelow, otherwise foams are usually produced. Since the art describes flash extrusion of the polymers dissolved in an organic solvent, the present invention represents a significant advance by allowing the use of water dispersions from which the water is flashed off and disposed of, and by permitting the polymer to be extruded at a very high rate of speed.

Organic polymers that can be employed in this invention include polyacrylonitrile and copolymers thereof with copolymerizable addition monomers, aliphatic polyamides such as 6-nylon, 66-nylon, and poly(bis-p-cyclohexylene methane sebacamide), aromatic and aromatic/aliphatic copolyamides such as poly(metaphenylene iso/terephthalamide), and poly(m-phenylene adipamide/sebacamide), polylactones such as polypivalolactone, polyesters such as poly(ethylene terephthalate) and copolymers thereof, cellulose esters such as cellulose acetate, polyolefins such as polyethylene and polypropylene and the like, and mixtures of such polymers which yield either compatible or incompatible extrudates. These polymers are substantially water-insoluble, i.e., they, or their water-association complexes form dispersions, rather than solutions, with the water.

Preferred polymers are polyacrylonitrile and copolymers of acrylonitrile and one or more suitable monoethylenically unsaturated monomers copolymerizable with acrylonitrile. Among the typical addition monomers exemplary of those copolymerizable with acrylonitrile are methyl acrylate, methyl methacrylate, vinyl acetate, styrene, methacrylamide, methacrylonitrile, vinyl chloride, vinylidene chloride, methyl vinyl ketone and the like as well as any of the available vinyl pyridines. The preferred comonomers include methyl acrylate, vinyl acetate, styrene and the vinyl pyridines. Also useful are various sulfonic acids such as styrene sulfonic, vinyl sulfonic, allyl sulfonic and methallyl sulfonic acids and their alkali-metal or alkaline-earth-metal salts, and the like; it being necessary only that the compound chosen from this class be copolymerizable with acrylonitrile to the desired extent. The preferred sulfonate comonomers are the sulfonated styrenes.

The dispersion to be extruded preferably contains a water insoluble inorganic oxide, their hydrates and salts thereof, to maintain stability of the dispersion. These additives can be present in amounts of 1% to 25% by weight based on the weight of the polymer employed. The additives include silica and alumina and their hydrates, titania, and silicates such as magnesium, calcium or aluminum silicates.

The dispersions may also, optionally, contain the usual surfactants such as the cationic, anionic or nonionic types. However, if good high-shear mixing is employed, these are not necessary.

The dispersion is obtained by blending the polymer with water in the desired amounts, along with any additives discussed above, if desired. It is desirable to mix the ingredients well to obtain a substantially uniform dispersion or slurry. A high-speed blender is suitable for this purpose.

Polymer concentration in the dispersion should be between about 25% and about 45% by weight based on the weight of the dispersion. A range of 30–45% is preferred. Above about 45%, foam strands begin to be produced and below about 25%, a discontinuous "fly" or "fluff" begins to appear. In addition, when employing the water-insoluble inorganic oxide, its hydrate or salt thereof, it is preferred to use concentrations toward the higher end of their permissible range, e.g., 10–25% by weight based on the weight of the polymer, and preferably 10–15%, because lesser amounts tend to produce foams depending on the temperature and the concentration of polymer.

The temperature at which extrusion occurs and the rate at which the dispersion is heated are important factors. In general, the higher the extrusion temperature, the better the plexifilament strand produced, since the rapid "flashing" of liquid water into its gaseous phase is important to the successful production of the plexifilaments. The temperatures employed will range between about 200° C. and 300° C., with 240° C. to 290° C. preferred. However, the temperatures used, and the length of time taken to heat the dispersion up, both bear on the quality of the dispersion to be extruded, for the polymers in the heated water are susceptible to degradation. To minimize degradation, the dispersion should be heated as rapidly as possible and should be extruded as soon as possible after reaching the desired extrusion temperature. Typically, time of heating does not exceed about 30 minutes. The temperature, of course, must be at least above the melting point of the polymer used, or its water-association complex if any.

The pressure at which the dispersion is to be extruded must be at least autogenous pressure and preferably will range from about 500 to about 1500 psig.

When acrylonitrile polymers are employed, it may sometimes be helpful to maintain the pH of the dispersion on the acidic side. For example, when a 93.8/6/0.1 acrylonitrile/methyl acrylate/sodium styrene sulfonate copolymer is used, the quality of the plexifilament strands produced is enhanced by using dispersions having a pH less than 5; while when a copolymer of 95/5 acrylonitrile/sodium styrene sulfonate is used a pH of less than 2 is desirable. The pH may be adjusted by adding an acid such as glacial acetic acid, sulfuric acid or the like.

The dispersion is maintained at the desired high temperature and pressure, then is abruptly extruded into a region of lower pressure and temperature, usually room temperature and pressure. The abrupt change in temperature and pressure causes the water to "flash", i.e., convert from liquid to gas, rapidly through the extrusion orifice, which in turn causes the formation of the plexifilament strands.

In order to maintain good uniformity of concentration in the dispersion, it is sometimes advantageous to employ a pressure let-down region, i.e., region of slightly reduced pressure, immediately adjacent the extrusion orifice to promote dispersibility just prior to extrusion.

The extrusion rate may range from 2000 yards per minute (ypm) or lower to 15,000 ypm. or even higher depending on the pressure, viscosity of the dispersion and the size of the extrusion orifice. The orifice is a single orifice and may range from 0.005" to about 0.1" in diameter.

The plexifilament strands produced by the process of this invention comprise a three-dimensional network of interconnected elements called fibrils. Usually the fibrils are less than 1$\mu$ in thickness and may be aggregated to larger fibrils of 5$\mu$ or less thickness. The fibrils may be thought of as an intermingled non-planar matrix of very thin film or ribbon-like elements that are irregularly interconnected (joined) at various points to form a web-like network or plexus.

The plexifilaments so produced are in the form of continuous strands (or yarns) and are characterized by high surface area, soft tactility and good cover. They are useful in the preparation of textile products, such as fabrics, tapes, ribbons, batts, and the like. Plexifilaments from acrylonitrile polymers or caprolactam are water-wettable and rapidly absorb and transport water, thus making them particularly useful in towelling fabric uses. Plexifilaments from other polymers useful herein, such as the polyesters, polyamides and polyolefins are hydrophobic, but can be rendered water-wettable with the assistance of a surfactant.

In the following examples, which illustrate the invention and are not meant to be limiting, parts and percentages are by weight unless otherwise indicated.

EXAMPLE 1 a. Thirty-five parts of a 1.5 intrinsic-viscosity copolymer of 93.9% acrylonitrile (AN), 5.98% methyl acrylate (MA) and 0.12% sodium styrene sulfonate (SSS) are blended, along with 3.5 parts aluminum silicate of 0.6$\mu$ particle size and 67 parts of water, in a kitchen-type blender for 2 minutes. The pH of the slurry is adjusted to 4.8 by the addition of 2 drops of glacial acetic acid. The resulting dispersion is then placed in a cylinder equipped with a spinneret having a single-hole 0.025"×0.050" (0.64×1.27 mm.) in diameter×length. A closely fitting Teflon®-gasketed free piston is inserted; the spinneret is closed by pressing a Teflon® pad against its face; and the cylinder is heated to 230° C. and held at that temperature for 5 minutes. Then the dispersion is heated to 260° C. while applying a nitrogen pressure of 800 psig (56 kg./cm.$^2$) behind the free piston. Heating time is 22 minutes. As the temperature reaches 260° C., the Teflon® pad is removed and the cylinder contents extruded into the atmosphere. The extrudate is a plexifilamentary strand.

When only 2 parts aluminum silicate is used a foamed filament is produced.

b. Example 1a. is repeated except that the amount of aluminum silicate is increased to 6.0 parts. The extrudate is a plexifilamentary strand having a very high degree of fibrillation.

EXAMPLE 2 a. Thirty-five parts of the polymer of Example 1, 1.75 parts of a commercial amorphous silica having a particle size of ~0.015$\mu$, and 65 parts of water are blended. The pH is not adjusted. It measured at 5.6. The slurry is heated and extruded as in Example 1. The extrudate is a continuous plexifilamentary strand. Similar results are obtained if the pH adjustment to 4.8 is performed.

b. Example 2*a.* is repeated except that 5.0 parts silica are used. The product is a continuous plexifilamentary strand of very high degree of fibrillation.

When 1.25 parts of the silica were used, a foam was produced.

EXAMPLE 3 a. Example 2*a.* is repeated except that 4 parts sodium metasilicate ($Na_2SiO_3.9H_2O$) are used as a substitute for the silica. The extrudate is a plexifilamentary strand having a medium degree of fibrillation.

b. Example 3*a.* is repeated except that 50 parts water are used (vs. 65) and 14.2 parts sodium metasilicate are employed; and the pH is adjusted to 6.0. The extrudate is a plexifilamentary strand having a high degree of fibrillation.

EXAMPLE 4 a. Example 2*a.* is repeated except that 3.0 parts of the silica is used as the stabilizer, and the pH is adjusted to 1.7 with sulfuric acid. The extrudate is a plexifilamentary strand mixed with foamed filament sections.

b. Example 4*a.* is repeated except that the pH is adjusted to 4.8. The product is a plexifilamentary strand of very high degree of fibrillation.

c. Thirty-five parts of the polymer of Example 1, 5 parts of finely ground aluminum silicate and 65 parts water are mixed and a few drops of dilute sodium hydroxide solution added to result in a pH of 8.22. The mixture is poured into apparatus such as described in Example 1 and extruded generally as described there, the mix being heated to 240° C., held at that temperature for 5 minutes and further heated to 255° C. before extrusion at 800 psig (56 kg./cm.$^2$) through a spinneret such as employed in Example 1. The product is a partially collapsed foamed strand, thus showing the effect of a high pH value.

d. Example 2*a.* is repeated without addition of silica. The extrudate is a foamed monofilament, thus showing the value of the use of an inorganic oxide with some acrylonitrile polymers.

EXAMPLE 5

This example illustrates the use of polyolefins in the practice of this invention.

a. A mixture comprising by weight 43% polyethylene (equal weights "Microthene" FN-510 from U.S.I. Chemicals and Grade 6 from Allied Chemical) which has a melt index of 206 at 140° C. (ASTM D1238-57-T), 1.9% silica, 1.0% "Aerosol"-OT and 9.5% stearic acid in water is extruded from the apparatus of Example 1*a.* at 200° C. and 800 psi (56 kg./cm.$^2$) after a total heating time of 11 minutes. The product, although somewhat nonuniform and weak, is a plexifilamentary strand having a medium degree of fibrillation.

b. A mixture comprising by weight 50% linear polypropylene, having a melt index of 4 at 203° C., and 10% "Aerosol"-OT in water is extruded from a miniautoclave at 260° C. and 1000 psi. The product is a coarsely fibrillated, plexifilamentary strand.

EXAMPLE 6

This example illustrates the use of other acrylic polymers in the practice of this invention.

a. Thirty-five parts of a 2.0 intrinsic-viscosity copolymer of 96% AN and 4% SSS, 3 parts silica and 65 parts water are blended as in Example 1. The pH is adjusted to 1.5 with sulfuric acid and the slurry spun as in Example 2*a.* except that hold up at 230° C. is 2 minutes instead of 5 minutes as in that example, and an extrusion orifice of 0.018"×0.018" (0.46×0.46 mm.) is used. A very highly fibrillated plexifilamentary strand is produced.

b. Twenty-four parts of 2.0 intrinsic-viscosity polyacrylonitrile (the homopolymer), 4.8 parts ethyl orthosilicate, 9.5 parts stearic acid and 61.7 parts water are blended and adjusted to pH 5 with sulfuric acid. The slurry is extruded as in Example 2*a.* with a hold time at 230° C. of 5 minutes, the total time of heating before extrusion being 22 minutes. The extruded product is a highly fibrillated plexifilamentary strand.

EXAMPLE 7

This example illustrates the use of polyamides in this invention. In parts d and e, silica has been omitted.

a. Thirty-five parts of 6-nylon, 5 parts silica and 65 parts water are blended as in Example 1 and the pH of the resulting slurry adjusted to 6.0 with sodium hydroxide. It is extruded as in Example 2*a.* The product is a plexifilamentary strand having a medium degree of fibrillation. In a second experiment, with adjustment of the pH to 7.2, the product is a mass of discontinuous fibrils.

b. Thirty-four parts of a commercial grade of 66-nylon having a relative-viscosity specification of 210–260, 7.7 parts silica, 1 part "Aerosol"-OT (the dioctyl ester of sodium sulfosuccinic acid) and 57.3 parts water are mixed and extruded in the apparatus of Example 1 at 230° C. under 1600 psig (112 kg./cm.$^2$) pressure through an orifice of 0.025"×0.023" (0.64×0.58 mm.) (diameter×length), the total time of heating before extrusion being 22 minutes. The product is a continuous, well-fibrillated plexifilament strand having a tenacity of 0.2 gpd and an elongation of 50% at the break. It has a high capacity for water, as illustrated by the fact that one gram of the product absorbs 5.3 g. water.

c. Forty parts of a 48 relative viscosity nylon produced by condensing bis-(p-aminocyclohexylene)methane and dodecanedioic acid, 4 parts silica, 0.8 part aluminum silicate, 1 part "Aerosol"-OT and 54.2 parts water are blended and spun as in the previous example at 280° C. under 1200 psig. (84 kg./cm.$^2$) pressure, through an orifice of 0.020"×0.040" (0.51×1.02 mm.) (diameter×length) after a heating time of 22 minutes. The product is a highly fibrillated plexifilamentary strand of 290 denier, having a tenacity of 0.33 gpd. and elongation at break at 18%. The product is hydrophobic.

d. Forty-one parts of the polymer of Example 7c., 0.8 part aluminum silicate, 1.0 part "Aerosol"-OT and 57 parts water are extruded at 280° C. under 1300 psig. (91 kg./cm.$^2$) pressure. The product is a closed-cell foam strand.

e. Eight parts of a 1.4 intrinsic-viscosity, 70/30 copolymer of poly(metaphenylene iso/terephthalamide), 25 parts water, 0.1 part boric acid and 0.05 part of manganese hypophosphite as heat stabilizer are mixed, heated in the cylinder of the foregoing examples to 270° C. over the course of 17 minutes and extruded under 1000 psig. (70 kg./cm.$^2$) pressure through an orifice of 0.04"×0.02" (1.02×0.51 mm.) (length×diameter). The product is a foam.

f. Ten parts of the polymer of Example 7e., 0.05 part manganese hypophosphite, 0.1 part boric acid, 0.5 part silica and 25 parts water are mixed and the pH found to be 4.8. It is processed as in the previous example at 270° C. (heating time of 25 minutes) and extruded under 1000 psig. (70 kg./cm.$^2$) pressure through an orifice 0.040"×0.020" (1.02×0.51 mm.) (length×diameter) to yield a coarsely fibrillated plexifilament having a tenacity of 0.48 gpd., an elongation of 2.5%, an initial modulus of 44 gpd. and a work-to-break of 0.11 gpd.

EXAMPLE 8

This example illustrates the use of polyesters in the practice of this invention.

a. Forty-five parts of 100 relative-viscosity poly(ethylene terephthalate), 5 parts silica, 1 part "Aerosol"-OT and 49 parts water are spun at 280° C. and 800 psig. (56 kg./cm.$^2$) as in Example 7. The product is a discontinuous plexifilamentary strand having a high degree of fibrillation.

b. Forty-five parts of an 88.2 relative-viscosity copolymer of 94% ethylene terephthalate and 6% ethylene sodium sulfo-iso-phthalate, 5 parts silica, 1 part "Aerosol"-OT and 50 parts water are mixed and spun as in Example 8*a.* at 285° C. under a pressure of 800 psig. (56 kg./cm.$^2$). The product is a continuous plexifilamentary strand having a medium degree of fibrillation.

c. The composition of Example 8*b.* except with omission of the "Aerosol"-OT is spun at 290° C. under 800 psig. pressure to yield a highly fibrillated but somewhat discontinuous plexifilamentary product.

EXAMPLE 9

This example illustrates the use of three additional polymer types in the practice of this invention.

a. Seven parts of finely ground (~30-mesh) ionomeric resin (89% ethylene, 11% methacrylic acid, neutralized with sodium) and 0.5 part silica are dry blended by hand, and the resulting powder is mixed with 9 parts water. The resulting slurry is placed in a cylinder such as employed in Example 2*a.* equipped with a single 0.025"×0.025" (0.64×0.64 mm.) orifice. After closing the orifice with a Teflon® pad, the slurry is compressed under the piston with 1000 psig (70 kg./cm.$^2$) nitrogen pressure and heated over the course of 25–30 minutes to 280° C. After holding at that temperature for an additional 5 minutes, the orifice is opened. The contents are forced out in less than one second to form a plexifilamentary strand of medium fibrillation and about 2500 denier.

b. Seven parts of ground (70-mesh) cellulose acetate, of 2.45 degree of substitution which has a viscosity of 113 poises in a 20% solution in acetone, and 0.5 part silica are dry-blended and then blended with 9 parts water to form a slightly moist crumb. This mixture is lightly tamped into a cylinder such as employed heretofore equipped with a single 0.018"×0.018" (0.46×0.46 mm.) extrusion orifice which opens at the outlet in a 30° flare to a ⅛"-diameter shroud about ⅛" long (0.32×0.32 cm.). The orifice is blocked with a Teflon® plug, the free piston loaded with 1000 psig (70 kg./cm.$^2$) nitrogen and the assembly heated over the span of 20–25 minutes to 200° C. After holding at this temperature for an additional 5 minutes, the extrusion orifice is opened. The entire contents are extruded within about 1 second to form a 600-denier plexifilamentary strand of medium fibrillation.

Other experiments show that such cellulose acetate plexifilamentary products can be hydrolyzed to yield a cellulose plexifilamentary product by heating the strand for 1¾ hours at 60°–65° C. in a water solution of 1% sodium hydroxide and 3% sodium acetate.

c. Forty-five parts poly(pivalolactone), of 2.5 inherent viscosity, 5 parts silica, 1.0 part "Aerosol"-OT and 49 parts water are spun in a manner similar to the foregoing at 287° C. under 800 psig. (56 kg./cm.$^2$) pressure, using a total heat-up period of 20 minutes, during 4 minutes of which the temperature is held at 280° C. The product is a highly fibrillated continuous plexifilamentary strand having a tenacity of 1.5 gpd., an elongation of 12% and an initial modulus of 22 gpd.

d. Sixty-three parts of the polymer of Example 9*c.*, 7 parts aluminum silicate and 30 parts water are spun at 280° C. under 1600 psig. (112 kg./cm.$^2$) pressure. The product is a foamed filament, thus showing the effect of increasing the amount of the polymer in the dispersion.

e. Thirty-five parts of the polymer of Example 9*c.*, 15 parts silica and 50 parts water are spun at 280° C. under 800 psig. (56 kg./cm.$^2$) pressure. The product comprises fluff and short lengths of fibrous material, thus indicating the boarderline lower limit of polymer concentration for this polymer.

f. Thirty-one parts of a polymer such as employed in Example 9*c.* but having an inherent viscosity of 1.6, 3.5 parts titania and 65.5 parts water are spun at 280° C. under 800 psig. (56 kg./cm.$^2$) pressure. The product is a foamed filament, thus showing the boarderline lower limit of concentration for this polymer.

g. Thirty-one parts of the polymer of Example 9*g.*, 3.5 parts microcrystalline asbestos and 65.5 parts water are spun at 280° C. under 800 psig. (56 kg./cm.$^2$) pressure. The product is a poorly fibrillated, plexifilamentary strand.

The next two examples illustrate utility of a mixture of polymers in the practice of this invention.

EXAMPLE 10

22.5 Parts of a poly(pivalolactone) such as that of Example 9*c.* and 22.5 parts of an acrylonitrile polymer such as that of Example 1*a.*, 5 parts silica, 1 part "Aerosol"-OT and 49 parts water are spun at 280° C. under 800 psig. pressure. The product is a highly fibrillated plexifilamentary strand.

EXAMPLE 11

A mixture of 22.5 parts 6-nylon, 22.5 parts of a copolymer such as employed in Example 1, 6 parts aluminum silicate and 49 parts water are charged into apparatus such as employed in Example 1 and heated to 250°–255° C. under a pressure of 800 psig. (56 kg./cm.$^2$), the total time of heating being about 20 minutes. A single 0.060×0.030 (1.52×0.76 mm.) (in length×diameter) spinneret is opened and the contents of the vessel are extruded as a finely fibrillated, continuous plexifilamentary yarn. Dyeing of the yarn with an acid dye, which is substantive only on the nylon component, illustrates that the nylon and acrylic plexifilaments are intimately interdispersed in the continuous strand.

Similar results are obtained if 66-nylon is substituted for the 6-nylon of this example and from a mixture of 30 parts 6-nylon with 15 parts of the acrylonitrile copolymer.

The composite products such as derived from the conjoint extrusion of two or more noncompatible polymer-melt emulsions, using the process of this invention, can be employed to produce a plexifilamentary product comprising only one of the polymers by selectively dissolving away one and leaving the other. The product of Example 10, for instance, can be treated with trifluoroacetic acid at room temperature to dissolve away the poly(pivalolactone) component, leaving the acrylic. Conversely, it can be treated with dimethylformamide at 80°–90° C. to dissolve away the acrylic component, leaving the poly(pivalolactone) component.

EXAMPLE 12

A polymer of 1.5 intrinsic viscosity consisting of 93.9% units derived from acrylonitrile, 5.98% methylacrylate and 0.12% sodium styrenesulfonate (3.314 kg.) is charged into a 19-liter, steam-jacketed autoclave equipped with a stirrer and bottom outlet along with 17.440 kg. of water. The contents are agitated to form a slurry, the autoclave is pressured to 105 kg/cm.$^2$ with nitrogen, and the vessel and contents heated over the course of about 30 minutes to 170° C. to form a water dispersion of acrylonitrile-polymer hydrate. Agitation is stopped for 5 minutes to allow settling of the hydrate to the bottom of the autoclave. The hydrate is metered at a rate of 278 g/min. into a mixing chamber along with 317 g/min. of water. The dispersion is forced through a 6.1-meter length of pressure tubing having a bore of approximately 0.78 cm. in which it is electrically heated to a temperature of 270° C. From the tubing, the dispersion is conducted at a pressure of 98 kg./cm.$^2$ through a filter, through a 0.051-cm. orifice into a chamber having a volume of about 8.2 cc. and thence through a 0.036-cm. orifice into the atmosphere to form a continuous strand of well-fibrillated plexifilaments which has tenacities as high as 1.5 gpd.

The process of this invention is also operated continuously as described in a general way as follows: A suitable vessel (e.g., a drum of 250-l. capacity) is equipped with an efficient agitator, a bottom outlet and a connection therefrom to a positive-displacement pump. Using means available in the art, the drum is fed continuously, at a rate to balance requirements of the process, 31.5 parts of an acrylic polymer, 4 parts aluminum silicate and 64.5 parts water. The feeds may comprise bone-dry polymer. Alternatively, a never-dried "filter cake" containing up to an amount of water about equal to the polymer content may be used, with appropriate adjustment of the water feed rate. When a suitable reserve quantity of slurry has been prepared and the feeds adjusted as described, the pump is started at a rate which delivers about 45 kg./hr. of slurry to an approximately 6-meter length of 62-cm.-inside-diameter tubing jacketed by 8.4 kg./cm.$^2$ steam. The pressure on the slurry is maintained at approximately 98 kg./cm.$^2$ to prevent flashing of water. The preheated mixture is further heated in an approximately 15-meter length of pressure tubing having a bore of about 7.7 mm. which is heated electrically.

After a residence of about one minute in the heaters, the mixture has a temperature in the range of 270°–300° C.; temperature is controlled precisely within this range at that which leads to best process performance. The mixture is passed through an orifice 1.02 mm×0.66 mm in length×diameter into a chamber 48.3 cm. in length and 0.64 cm. in diameter. The chamber contains, first, a multi-vaned static mixer designed to mix the fluid by multiple reversals of turbulent swirling; and, second, a filter comprising a total of 18 screens of two alternating sizes: (a) 7.87 meshes/cm. with effective openings of 0.833 mm and (b) 18.9 meshes/cm. with effective openings of 0.295 mm. The mixture in the chamber has a temperature of about 280° C. and a pressure of about 84 kg./cm.$^2$. From this chamber, the mixture is extruded through a second orifice 0.46 mm in both length and diameter which is relieved on the exit side in a 70° flare 2.54 mm in length. The exit diameter of the flare is 3.05 mm.

The product of such a process is about 16 kg./hr. of a well-fibrillated plexifilamentary strand. The speed of emergence of the strand is in the range of from 9000 to 11,000 meters per minute.

The foregoing detailed description has been given for clearness of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. In the process for producing plexifilament strands from an organic, synthetic, substantially water-insoluble fiber-forming polymer which either of itself or its water-association complex has a melting point between 100° and 300° C., by flash-extruding the polymer in a volatile liquid at a temperature above the melting point of the polymer into a region of substantially lower temperature and pressure where the liquid flash-vaporizes; the improvement for avoiding the use of organic solvents while providing for extremely rapid spinning which comprises dispersing said polymer in water to form a substantially uniform dispersion containing between about 25 percent and 45 percent by weight of polymer based on the total weight of dispersion, heating the dispersion to a temperature between about 200° C. and about 300° C. to melt the polymer or its water-association complex while maintaining the dispersion uniform and under a pressure at which the water is liquid, the rate of heating being such that the time of heating does not exceed about 30 minutes, and promptly flash-extruding the dispersion in liquid water from an orifice into a region of substantially lower temperature and pressure to form a continuous strand of fibrillated plexifilaments.

2. The process of claim 1, wherein said dispersion contains between about 1 percent and 25 percent by weight, based on the weight of the polymer, of a water-insoluble nucleating agent stabilizer selected from the group consisting of alumina, silica, titania, and inorganic silicates.

3. The process of claim 1, wherein said dispersion contains between about 30 percent and 45 percent by weight of polymer based on the total weight of dispersion.

4. The process of claim 3, wherein said dispersion is heated to a temperature between about 240° C. and about 290° C.

5. The process of claim 4, wherein said dispersion is heated under a pressure between about 500 and about 1500 psig.

6. The process of claim 5, wherein the dispersion contains between about 3 percent and 25 percent by weight of aluminum silicate, based on the weight of the polymer.

7. The process of claim 5 wherein the dispersion contains between about 3 percent and 25 percent by weight of silica, based on the weight of polymer.

8. In the process for producing plexifilament strands from polyacrylonitrile or copolymers of acrylonitrile and monoethylenically unsaturated monomers copolymerizable with acrylonitrile, by flash-extruding the polymer in a volatile liquid at a temperature above the melting point of the polymer into a region of substantially lower temperature and pressure where the liquid flash-vaporizes; the improvement for avoiding the use of organic solvents while providing for extremely rapid spinning which comprises dispersing an acrylonitrile polymer, either itself or its water-association complex having a melting point between 100° C. and 300° C., in water to form a substantially uniform dispersion containing between about 25 percent and 45 percent by weight of polymer based on the total weight of dispersion, heating the dispersion to a temperature between about 200° C. and 300° C. while maintaining the dispersion uniform and under a pressure at which the water is a liquid, the rate of heating being such that the time of heating does not exceed about 30 minutes, and promptly flash-extruding the dispersion from an orifice into a region of substantially lower temperature and pressure to form a continuous strand of fibrillated plexifilaments.

9. The process of claim 8, wherein the dispersion contains between about 3 percent and 25 percent by weight, based on the weight of the polymer, of a water-insoluble nucleating agent stabilizer selected from the group consisting of alumina, silica, titania, and inorganic silicates.

10. The process of claim 9, wherein said dispersion contains between about 30 percent and 45 percent by weight of polymer based on the total weight of dispersion.

11. The process of claim 10, wherein said dispersion is heated to a temperature between about 240° C. and about 290° C.

12. The process of claim 11, wherein the pH of the dispersion is adjusted to make the dispersion acidic.

13. The process of claim 12, wherein the dispersion contains between 10 percent and 15 percent by weight of aluminum silicate, based on the weight of polymer.

14. The process of claim 12, wherein the dispersion contains between 10 percent and 15 percent by weight of silica, based on the weight of polymer.

* * * * *